US006565375B1

(12) United States Patent
Daoud et al.

(10) Patent No.: US 6,565,375 B1
(45) Date of Patent: May 20, 2003

(54) MODIFIED CONNECTOR MODULE WITH INTEGRATED PUSH CAP FOR WIRE TERMINATION

(75) Inventors: Bassel Hage Daoud, Parsippany, NJ (US); Christopher M. Helmstetter, Bridgewater, NJ (US)

(73) Assignee: Avaya Technology Corp., Basking Ridge, NJ (US)

( * ) Notice: Subject to any disclaimer, the term of this patent is extended or adjusted under 35 U.S.C. 154(b) by 0 days.

(21) Appl. No.: 09/109,275

(22) Filed: Jun. 30, 1998

(51) Int. Cl.[7] ..... H01R 11/20
(52) U.S. Cl. ..... 439/409; 439/403
(58) Field of Search ..... 439/389–426, 439/942

(56) References Cited

U.S. PATENT DOCUMENTS 3,923,362 A * 12/1975 Dunn et al. ..... 439/200
4,964,812 A * 10/1990 Siemon et al. ..... 439/403
5,662,493 A * 9/1997 Reichle ..... 439/409
5,989,054 A * 11/1999 Fasce ..... 439/409

* cited by examiner

*Primary Examiner*—Tulsidas Patel
*Assistant Examiner*—Son V. Nguyen
(74) *Attorney, Agent, or Firm*—Thomas, Kayden, Horstemeyer & Risley, LLP

(57) ABSTRACT

A modified connector module having integrated push caps for wire termination. The integrated push caps simplify the operation of and allows connection or rearrangement of a single pair of conductors. The modified connector module having alternating height teeth and a plurality of insulation displacement connectors placed therebetween. Each integrated push cap having a pair of ribs for snubbing and seating a pair of conductors into the insulation displacement connectors and one or more pair of chambers for isolating and gripping the ends of the conductors.

20 Claims, 7 Drawing Sheets

MODIFIED CONNECTOR MODULE WITH INTEGRATED PUSH CAP FOR WIRE TERMINATION

FIELD OF THE INVENTION

The invention relates to an improved device for making electrical connections between a plurality of conductors, which reliably grips and isolates the ends of the conductors, allows the connection of a single pair of conductors and simplifies the operation of accomplishing electrical connections without the aid of extraneous tools; and, particularly, relates to connections between telephone lines at a network interface unit.

BACKGROUND OF THE INVENTION

At present, a wide variety of conductor splicing electrical connectors are used in telephone systems. Generally, these connectors comprise at least two separate and distinct elements, is namely, an index strip and a connector module. U.S. Pat. No. 3,798,587 to B. C. Ellis, Jr. et al. ("'587 patent") discloses one such typical wire connecting blacks, wherein the index strip has a plurality of teeth of alternating height which are spaced-apart, and the connector module has a plurality of slotted insulation displacement connectors and a plurality of teeth of alternating height and spaced-apart, identical to those of the index strip. The '587 patent discloses electrical connections between two sets of conductors are accomplished by first placing the first set of conductors along slots between the spaced-apart teeth of the index strip and the second set of conductors between slots of the insulation displacement connectors of the spaced-apart teeth of the connector module. Then the connector module is placed over the index strip, with the slotted insulation displacement connectors making electrical connection between the first and second set of conductors by penetrating the insulation.

U.S. Pat. No. 4,118,095 to R. N. Berglund et al. ("'095 patent") discloses an improved two-element wire connecting block. Significantly, the '095 patent modifies the connector module disclosed in the '587 patent to facilitate alignment of the slotted insulation displacement connectors and to provide an integral skirt for maintaining electrical isolation of the end of the first set of conductors to minimize short circuits between conductors.

Further improvement of the two-element system is the addition of a third element, a cap module, as disclosed in U.S. Pat. No. 3,772,635 to D. R. Frey et al. ("'635 patent") and U.S. Pat. No. 4,262,985 to A. A. Muehlhausen II ("'985 patent"). The '635 patent discloses a cap module, for use with a modified index strip and a modified connector block, which serves the purpose of snubbing the second set of conductor ends. The '985 patent discloses a cap module capable of gripping, snubbing and isolating the second set of conductor ends. The cap module of both the '635 and the '985 patents are snap-mounted onto the connector module with a latch-hole interlocking mechanism.

Normally the assembly of the wire connecting blocks disclosed in these patents require an expensive tool such as that disclosed in the '635 patent and U.S. Pat. No. 3,898,724 to T. A. Conorich ("'724 patent"). The seating tool is used to trim and properly snub the conductors into slots between the spaced-apart teeth of the wire connecting blocks to achieve electrical connections.

U.S. Pat. Nos. 3,772,635, 3,798,587, 3,898,724, 4,118,095 and 4,262,985 discussed above are hereby incorporated by reference as background of the invention.

Prior art wire connecting blocks described above are suitable for installation and for rearrangement of a large-scale telephone system because typical connector modules and seating tools are designed to make multiple pairs of electrical connections at one time. Once a telephone system had been properly installed and all electrical conductors pre-connected, rearrangement of a large-scale network interface unit require a visit from a skilled telephone service technician, who can work through the complex maze of telephone connections and is likely to possess an expensive seating tool for making efficient and effective connections. Rearrangement of a large-scale network interface unit justifies a visit from a telephone service technician or the purchase of a seating tool, which can be time consuming and costly.

When rearrangement of a network interface unit involves only a few electrical connections, it does not justify the cost of purchasing an expensive seating tool or requiring a visit from a telephone service technician. However, with prior art wire connecting blocks, such a task cannot be effectively accomplished without the assistance of a seating tool or a telephone service technician, adding materially to the cost and time expended.

In order to rearrange electrical connections of a telephone system, it is necessary to first trace the telephone connections to the connector module located in the network interface unit, disassemble the electrical connections from the slots of the connector module and then reassemble the electrical connections at slots corresponding to the desired connections on the index strip.

Prior art wire connecting blocks contain a number of shortcomings when handled by an inexperienced person. For example, the two-element prior art wire connecting block does not provide a reliable positive grip of the electrical conductors to allow secure tracing of the wires. The two-element wire connecting block also provides minimum to no electrical isolation of the conductor ends. Furthermore, proper use of the two-element wire connecting block requires an expensive seating tool. On the other hand, while a three-element prior art wire connecting block eliminates some of these drawbacks, it requires the removal of the cap module before the removal of the electrical connections from the connector module. Such a cap module is generally snap mounted onto the connector module by way of a spring-latch-hole interlocking feature, making its removal difficult. Even if removal of the cap module is successful, it can be easily lost or misplaced.

It is therefore the aim of this invention to provide an improved connector module of a wire connecting block that facilitates the rearrangement of electrical connections in a simple, positive manner, even by unskilled persons.

SUMMARY OF THE INVENTION

The invention provides an improved device for making electrical connections between conductors. The invention improves upon a two-element prior art wire connecting block to achieve benefits of and beyond a three-element prior art wire connecting block.

The invention provides an integrated push cap that facilitates rearrangement of electrical connections without the assistance of a service technician. The integrated push cap also serves to snub electrical conductors into slotted insulation displacement connectors, thereby eliminating the need of a specialized seating tool.

The invention further provides isolation of the ends of the electrical conductors to minimize short circuits between conductors in an outdoor environment. The invention also provides strain relief on the electrical conductors at the point of contact with the slotted insulation displacement connectors.

The invention provides reliable gripping of electrical conductors to allow secure tracing of wires to the wire connecting block.

The invention, when used for telephone wire connections, contemplates an improved connector module for use in conjunction with existing prior art index strip, such as those described in U.S. Pat. Nos. 3,798,587 and 4,118,095. The improved connector module of this invention has a plurality of alternating height, spaced-apart, teeth and a plurality of slotted insulation displacement connectors, such as shown in existing prior art connector modules. The improved connector module also has an integrated push cap, pivotable from an open to closed positions. In the closed position, the push cap is designed to fit over a predetermined sequence of alternating height, spaced-apart, teeth. A protuberance-recess locking mechanism is provided to keep the push cap in a closed position, yet allows repetitive opening and closing of the push cap. The push cap has a pair of notched ribs on the bottom surface for snubbing and seating a pair of electrical conductors in the slotted insulation displacement connectors.

Housed within the improved connector module are one or more pairs of openings, such as cylindrical chambers, designed to fit different gauge wires, such as a 22 or 26 gauge wire. The chambers are positioned in alignment with the slots between the teeth. The ends of electrical conductors are inserted into the mating chambers while the push cap is in an open position, with the body of the electrical conductors resting in the spaces between the alternating height teeth in position for snubbing and seating into the insulation displacement connectors. Upon closing the push cap, the electrical conductors are seated in the slotted insulation displacement connectors, with the ends of the conductors displaced at an angle, forming the letter "L." The chambers effectively isolate the ends of the conductors. The L-shaped conductors serve as strain relieve at the point of contact with the slotted insulation displacement connectors. Furthermore, in combination with the protuberance-recess locking mechanism, the angle created along the conductors securely grip the conductors.

DETAILED DESCRIPTION OF THE PREFERRED EMBODIMENTS

Figure 1:
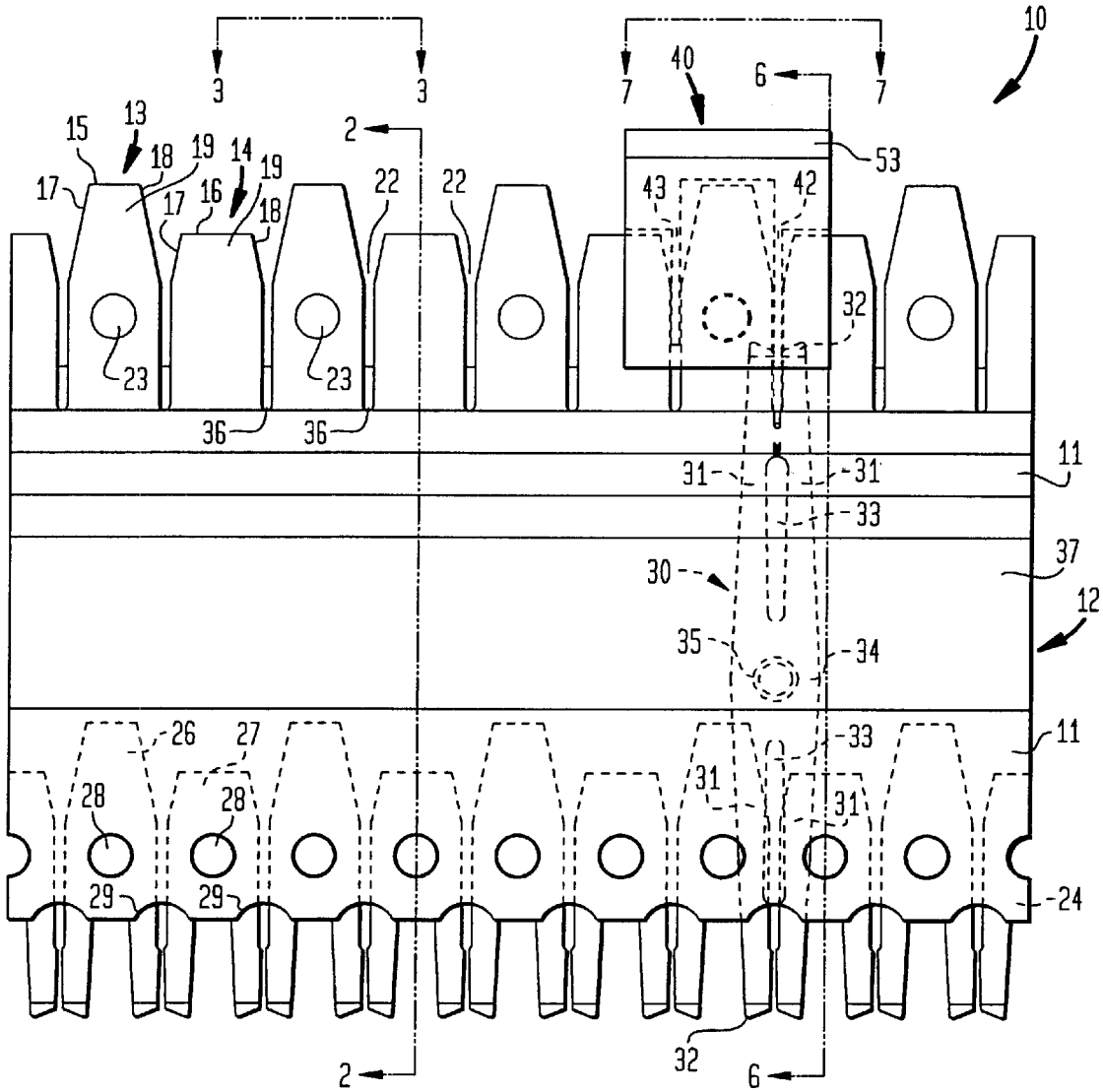
FIG. 1 is a front elevational view of the modified connector module with one integrated push cap of the present invention in the closed position with the remaining push caps in the open position.

With reference to the drawings, wherein the same reference number indicates the same element throughout, there is shown in FIG. 1 a modified connector module 10 in accordance with the present invention, showing one integrated push cap 40 in a closed position.

Figure 2:
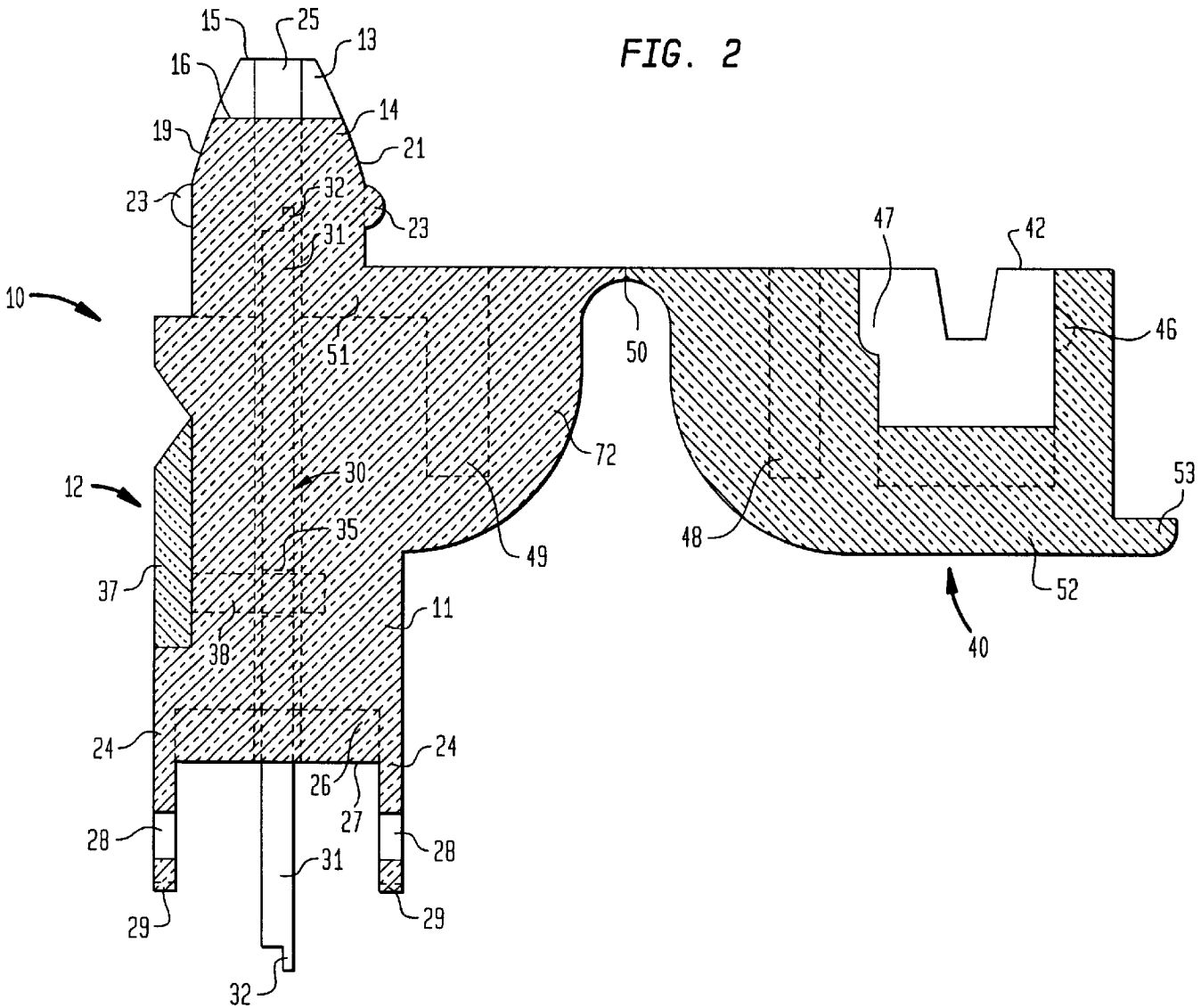
FIG. 2 is a cross sectional view of the modified connector module, in an open position, taken along line 2—2 in FIG. 1.

The connector module 10 includes a body member 11 having a plurality of slotted insulation displacement connectors 30 which are slidably mounted within elongated channel cavities 25 of body member 11 and held in place by anchoring member 12, as best seen in FIG. 2. Body member 11 and anchoring member 12 are made of a dielectric material and insulation displacement connectors 30 are made of electrically conducting material.

The upper portion of the body.member 11 includes a plurality of spaced-apart alternating height teeth 13 and 14 respectively extending upwards. Each tooth 13 and 14 has essentially a flat top surface 15 and 16, respectively, and tapered sidewalls 17 and 18 shown in FIG. 1 and tapered sidewalls 19 and 21, shown best in FIG. 2. The tapered sidewalls 17 and 18 of adjacent alternating height teeth 13 and 14 define funnel shaped entry slots 22 therebetween, where electrical conductors 20 are positioned for wire termination. Each of the taller alternating height tooth 13 has a pair of protuberances 23 extending from sidewalls containing tapered surfaces 19 and 26, respectively.

Figure 6:
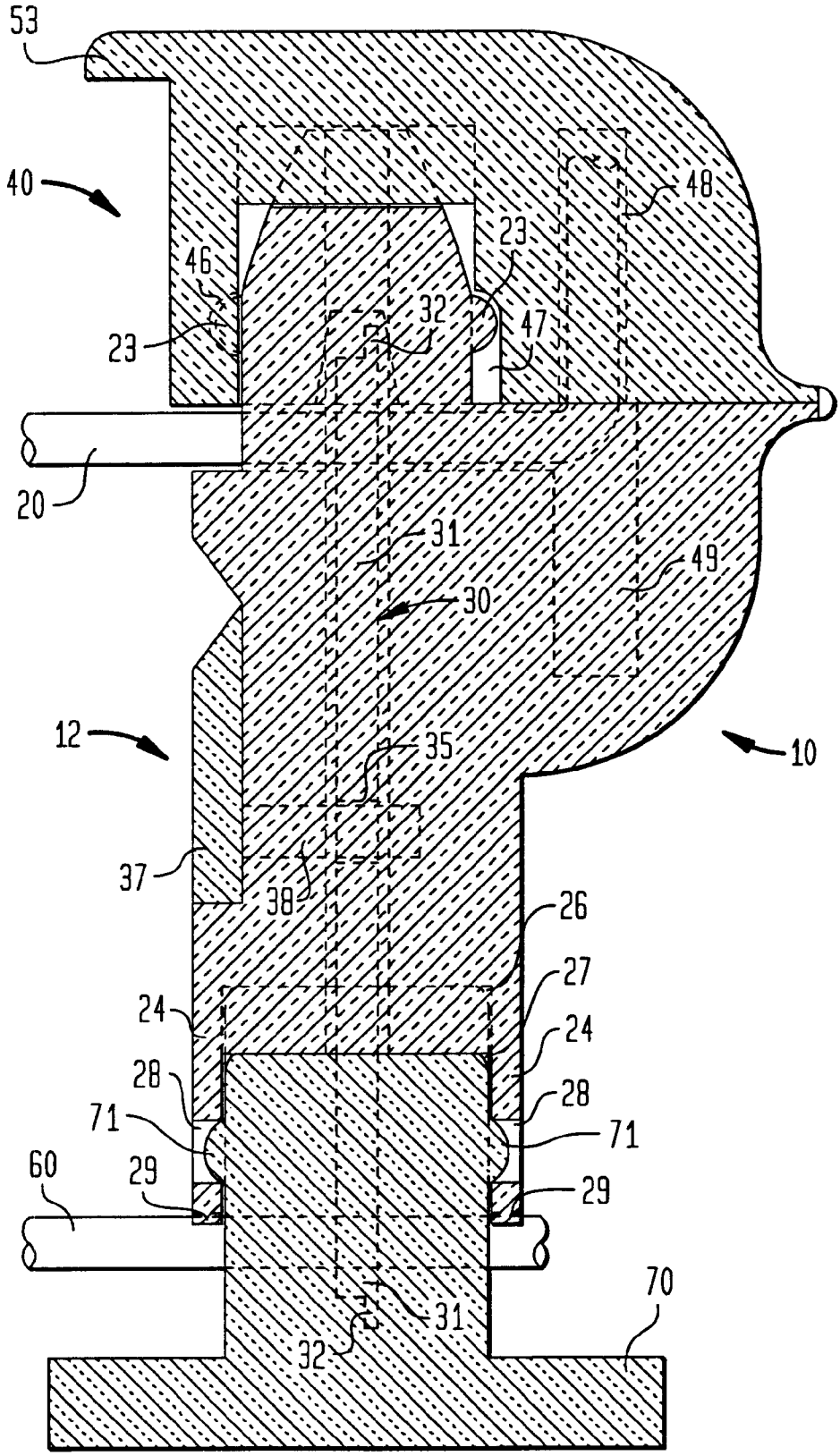
FIG. 6 is a cross sectional view of the modified connector module, in a closed position, taken along line 6—6 in FIG. 1, mounted on a prior art index strip to illustrate an assembled wire connecting block.

The bottom portion of body member 11 includes a pair of spaced-apart legs 24 for straddling a prior art alternating height teeth index strip 70, as shown in FIG. 6. Index strip 70 is similar to element 11 in FIG. 1 as illustrated in U.S. Pat. No. 4,118,095 issued to Berglund et al. on Oct. 3, 1978. The space between the legs 24 has cavities of alternating depth 26 and 27, to accommodate corresponding alternating height teeth of the prior art index strip (see FIG. 6). As seen best in FIG. 6, each leg 24 has a plurality of mating apertures 28 for snap engaging corresponding protuberances 71 of index strip 70, similar to those illustrated as element 24 in FIG. 2 in U.S. Pat. No. 4,118,095 issued to Berglund et al. on Oct. 3, 1978. Along the bottom edge of each leg 24 are a plurality of scallop edging 29 for engaging a corresponding electrical conductor 60, as shown in FIG. 6, and holding them in place between index strip 70 and the connector module 10.

Each insulation displacement connector 30 includes first and second pairs of oppositely directed cantilever beams 31 with pointed and tapered ends 32. Each pair of beams 31 extends from a central portion 34, with an elongated slot 33 defined therebetween. In the central portion 34 is an aperture 35 which allows engagement of the anchoring member 12 in mounting the insulation displacement connector 30 within the body member 11.

The anchoring member 12, best shown in FIGS. 1 and 2, comprises a flat and rectangular shaped strip 37 having a plurality of cylindrical protrusions 36 having a diameter slightly less than the diameter of the apertures 35 of said insulation displacement connectors 30. After the insulation displacement connectors 30 are slid into the channel cavities 25 of said body member 11, the cylindrical protrusions 38 engage apertures 35 of said insulation displacement connectors 30 through a plurality of openings 39 on said body member 11. After engaging the anchoring member 12 with the body member 11, they are secured to each other by, for example, ultrasonic welding.

The connector module 10 has a plurality of integrated push caps 40, corresponding to the number of pairs of available funnel shaped entry slots 22 for electrical conductors 20. FIG. 2 shows one such integrated push cap 40 in an open position on the connector module 10. Push cap 40 is pivotable at the pivot point 50 of body extension 72 of body member 11 between an open and closed position. FIG. 2 shows push cap 40 in an open position and FIG. 6 shows push cap 40 in the closed position overlying a taller tooth 13 and abutting slots 22. Pivot point 50 as shown in FIG. 2 is shown as a living hinge, allowing repetitive opening and closing of push cap 40, but any other pivotable means known to one skilled in the art may be substituted.

Figure 3:
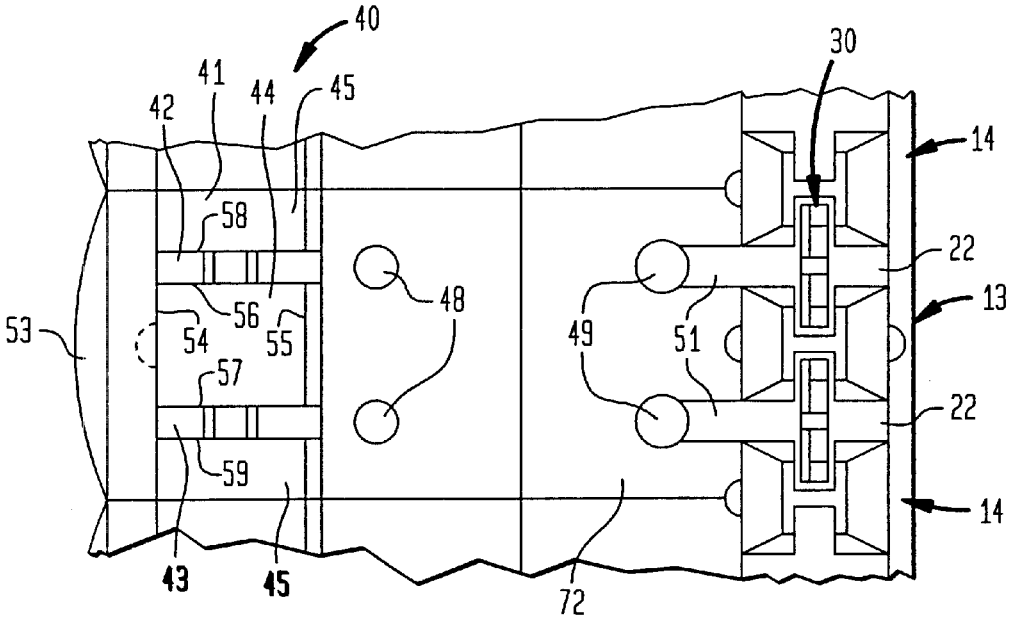
FIG. 3 is a top plan view of the modified connector module in an open position, taken along line 3—3 in FIG. 1.

FIG. 3 illustrates the bottom surface of push cap 40. Push cap 40 has a hollow interior 41, segregated into three sections by two substantially parallel notched ribs 42 and 43, a central cavity 44 and a pair of end open sections 45. The notched ribs 42 and 43 are positioned in alignment with consecutive funnel shaped entry slots 22, with the central cavity 44 mating with the straddled aligned tooth 13. cavity 44 is defined by front and rear walls 54 and 55, respectively, of push cap 40 and inner facing walls 56 and two notched ribs 42 and 43, respectively. The pair of sections 45 are defined by the front and rear walls 54 and 55, respectively, of push cap 40 and the outer facing walls 58 and 59 of the two notched ribs 42 and 43, respectively. Cavity 44 of push cap 40 is designed to enclose a corresponding tooth 13 and each of the end sections 45 are adapted to fit over corresponding teeth 14 abutting tooth 13, best shown in FIGS. 1 and 5. The notched ribs 42 and 43 are sized to fit between the aligned funnel shaped entry slots 22 and over the insulation displacement connectors 30 (best shown in FIGS. 1 and 3). On front wall 54 of cavity 44 is a circular recess or opening 46 and on the opposite rear wall 55 of cavity 44 is a recessed ledge 47, both recesses 46 and 47 correspond with the pair of protuberances 23 on tooth 13 when push cap 40 is in a closed position, to form a locking mechanism that allows repetitive opening and closing of push cap 40.

As shown in FIG. 3, push cap 40 also contains a pair of cylindrical chambers 48. A second pair of cylindrical chambers 49, having a different diameter than chambers 48, are located at the body extension 72 of body member 11. Chambers 48 and 49 are designed to accommodate electrical conductors of different gauges. For example, chambers 48 may be sized for 26 gauge wires and chambers 49 sized for 22 gauge wires. However, both pairs of chambers 48 and 49 may be positioned in either the push cap 40 or body extension 72. Further, there may be more than two pairs of chambers to provide more variations in diameter. Each pair of the chambers 48 and 49 are in alignment with corresponding notched ribs 42 and 43 and the funnel shaped entry slots 22 immediately adjacent to alternative height tooth 13. A pair of channels 51 connect chambers 49 to the base 36 of the alternating height teeth 13 and 14.

As best shown in FIG. 2, the top surface 52 of push cap 40 extends over push cap 40 to form a ledge 53 to facilitate operation of push cap 40 between an open and closed position and aid in unlocking the protuberance-recess locking mechanism of protuberance 23 and recess 46.

Figure 4:
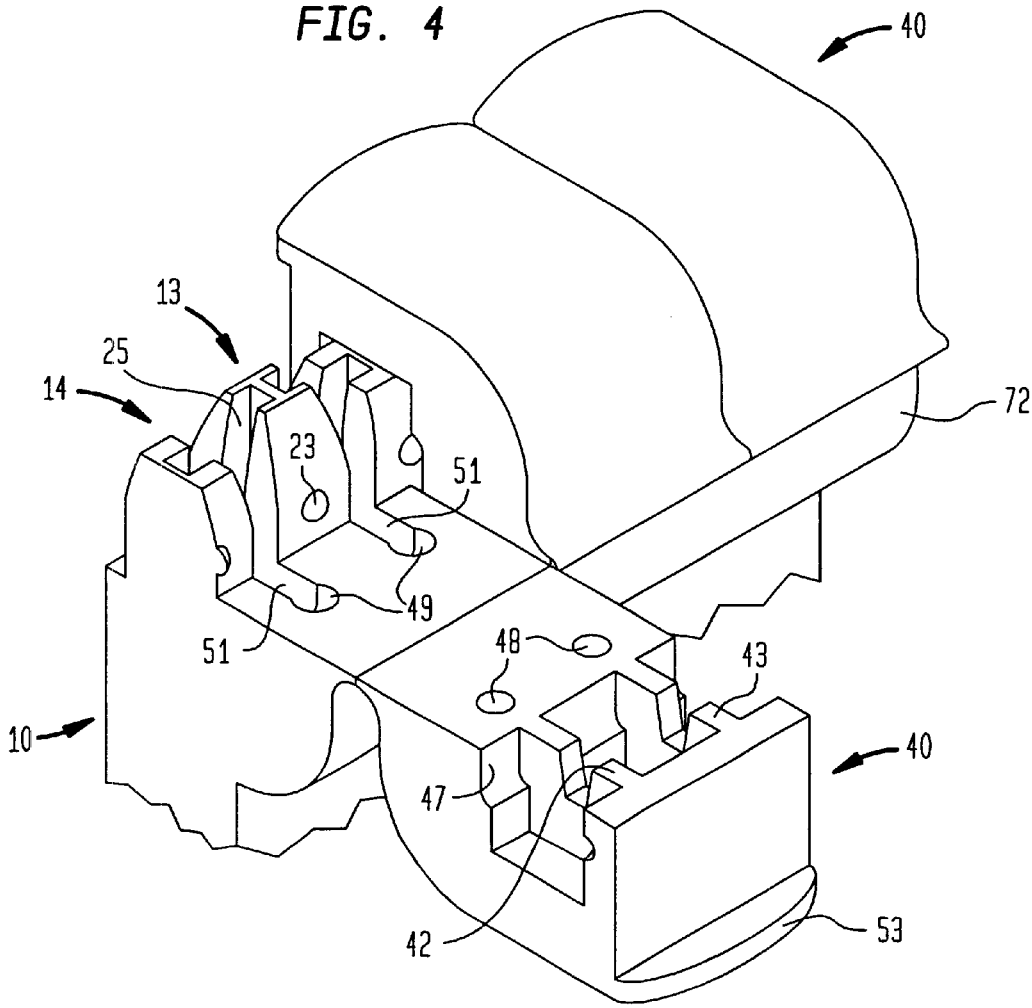
FIG. 4 is a perspective view of the modified connector module having three integrated push caps, one of which is in the open position.

FIG. 4 illustrates the features of push cap 40 as described in conjunction with FIGS. 2 and 3, but in a perspective view.

Figure 5A:
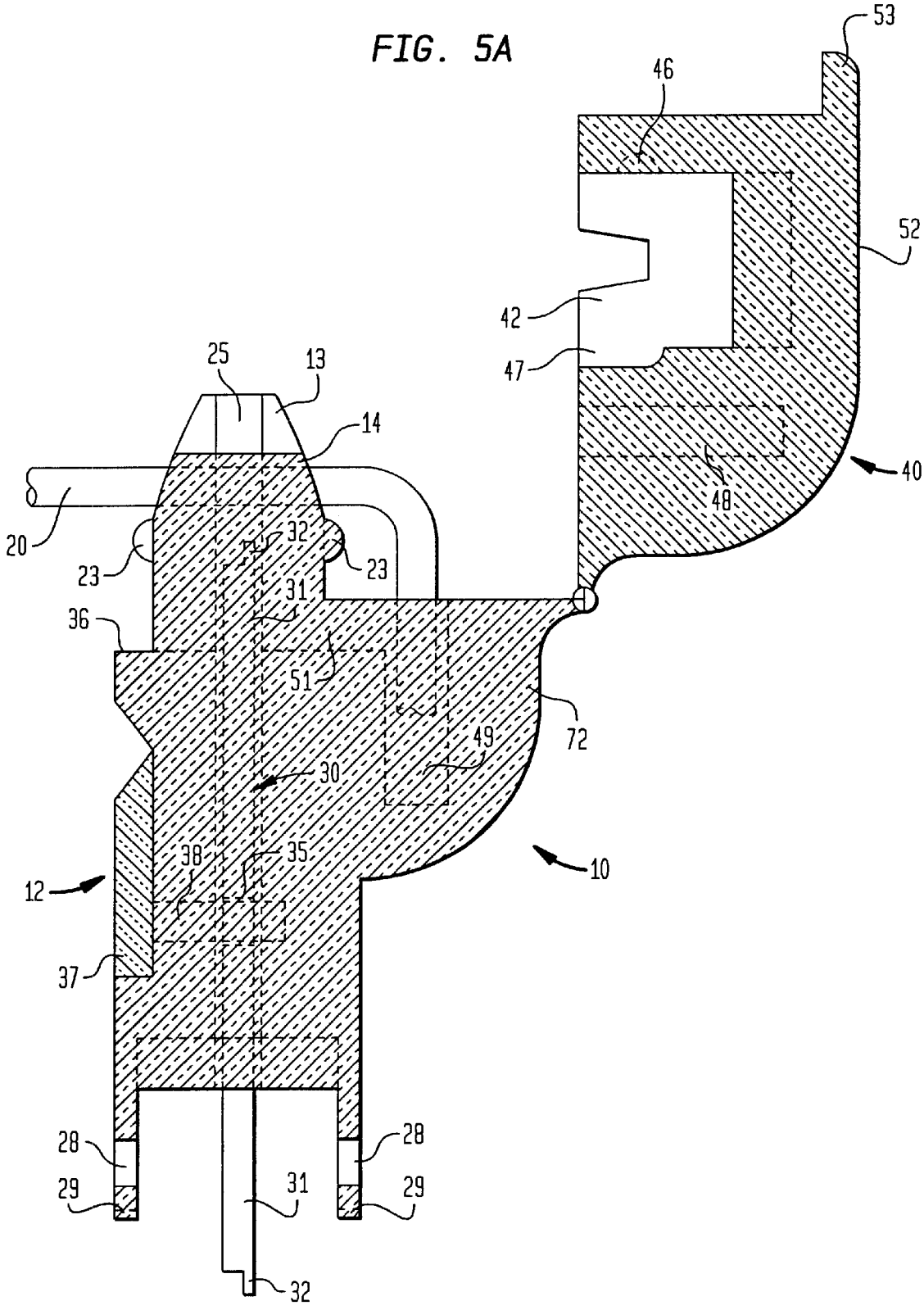
FIG. 5A is a cross sectional view of the modified connector module, in an open position, taken along line 2—2 in FIG. 1, illustrating insertion of the conductor end to a larger chamber.
Figure 5B:
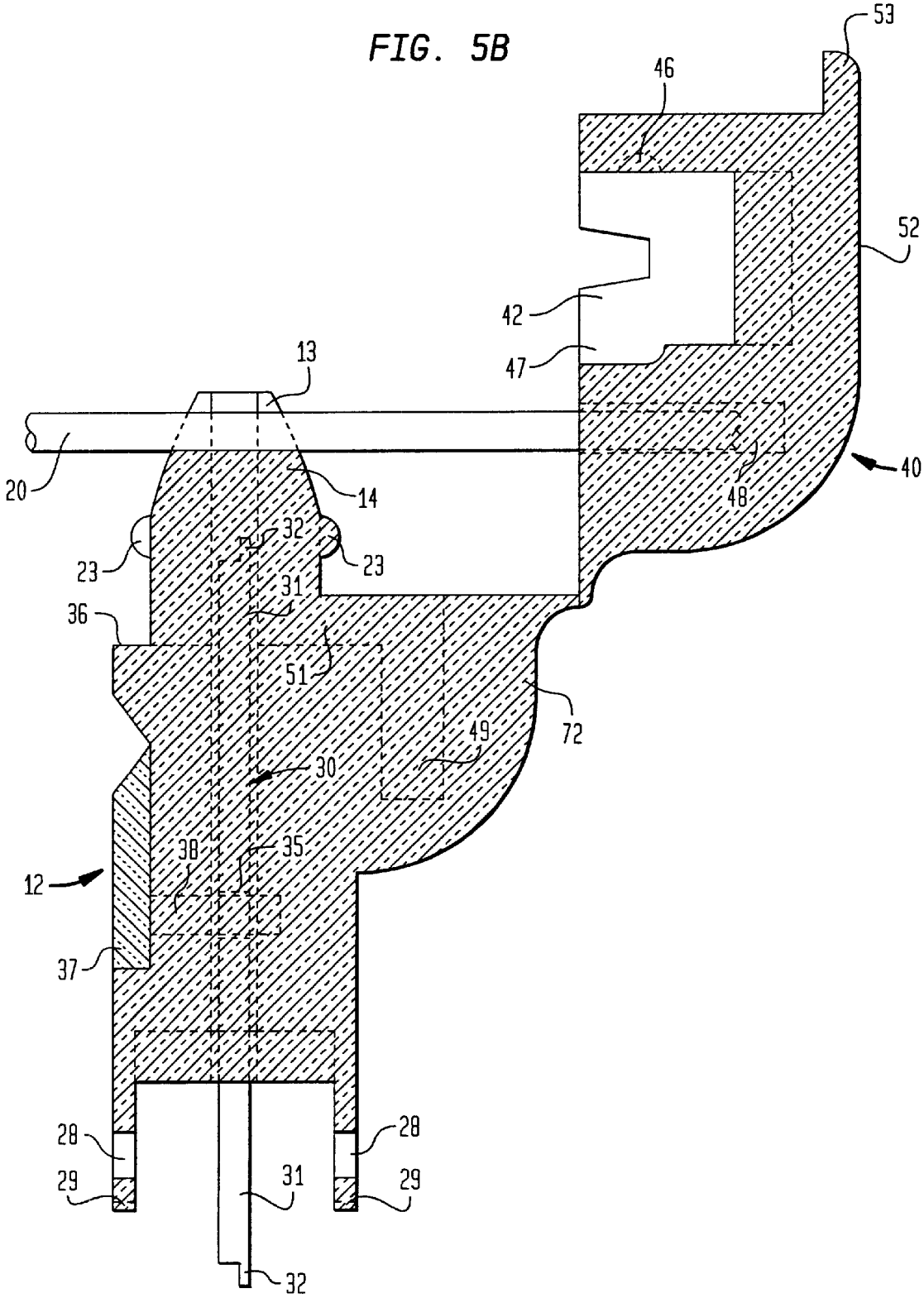
FIG. 5B is a cross sectional view of the modified connector module, in an open position, taken along line 2—2 in FIG. 1, illustrating insertion of the conductor end to a smaller chamber.

FIGS. 5A and 5B illustrate the positioning of two different sizes of electrical conductor 20 to the modified connector module 10 in achieving wire termination. As shown in FIG. 5A, the ends of a pair of 22 gauge conductors 20 are inserted into the pair of chambers 49 with the body of the conductors 20 resting in their respectively aligning funnel shaped entry slots 22. While pivoting the push cap 40 to a closed position, the ribs 42 and 43 come into contact with the pair of conductors 20 resting in the funnel shaped entry slots 22. Upon closing the push cap 40, the ribs 42 and 43 will engage, seat and snub the conductors 20 between the first pairs of beams 31 of the insulation displacement connectors 30 along their respective channels 51 at the base 36 of contiguous alternating height teeth 13 and 14, thereby penetrating the insulation of the conductors 20 and achieving contact with the insulation displacement connectors 30. The tapered sidewalls 17, 18, 19 and 21 of the alternating height teeth 13 and 14 and the recessed ledge 47 provide clearance to pivot push cap 40 from an open to a closed position.

FIG. 5B similarly illustrates the proper seating and snubbing of a pair of 26 gauge electrical conductors 20 into funnel shaped entry slots 22 to make contact with the insulation displacement connectors 30. The push cap 40 is first pivoted to a ninety degree angle, half-way between the fully open and fully closed positions. The ends of the pair of conductors 20 are then inserted into the pair of chambers 48, with the body of the conductors 20 resting in their respectively aligning funnel shaped entry slots 22. Again, the pivoting action of the push cap 40 bring the ribs 42 and 43 into contact with the corresponding conductors 20 resting in funnel shaped entry slots 22. Upon fully closing the push cap 40, the ribs 42 and 43 seat and snub their corresponding conductors 20 between the first pairs of beams 31 of the insulation displacement connectors 30 along their respective channels 51 at the base 36 of alternating height teeth 13 and 14, thereby penetrating the insulation of the conductors 20 and achieving contact with the insulation displacement connectors 30, as shown in FIG. 6.

FIG. 6 illustrates connector module 10 mounted on a prior art index strip 70 where electrical contacts are established between each of the first pair of conductors 20 and a corresponding second pair of conductors 60 via the insulation displacement connector 30. The pair of spaced apart legs 24 of connector module 16 straddle index strip 70, with cavities 26 and 27 mating corresponding alternating height teeth of the index strip 70. Apertures 28 of legs 24 engage a pair of protuberances 71 of index strip 70 to secure the connector module 10 to the index strip 70. Scallop edging 29 of legs 24 engage electrical conductors 60 to hold the conductors 60 in place.

As shown in FIG. 6, the ends of electrical conductors 20 are fully enclosed and isolated within chambers 48. The electrical conductors 20 are bent at a ninety degree angle with the push cap 40 in the closed position. The L-shaped conductors 20 relieve pressure exerted on the conductors 20 at the point of contact with the insulation displacement connectors 30 and provide additional gripping of conductors 20. Reliable gripping of conductors 20 is further enhanced by the locking mechanism of push cap 40. Push cap 40 maintains its closed position with the engagement of the circular recess 46 with protuberance 23 on the sidewall 19. A ledge 53 on push cap 40 is provided to facilitate the opening of the push cap 40 by releasing the latched circular recess 46 from protuberance 23 with a simple pull of a finger.

Figure 7:
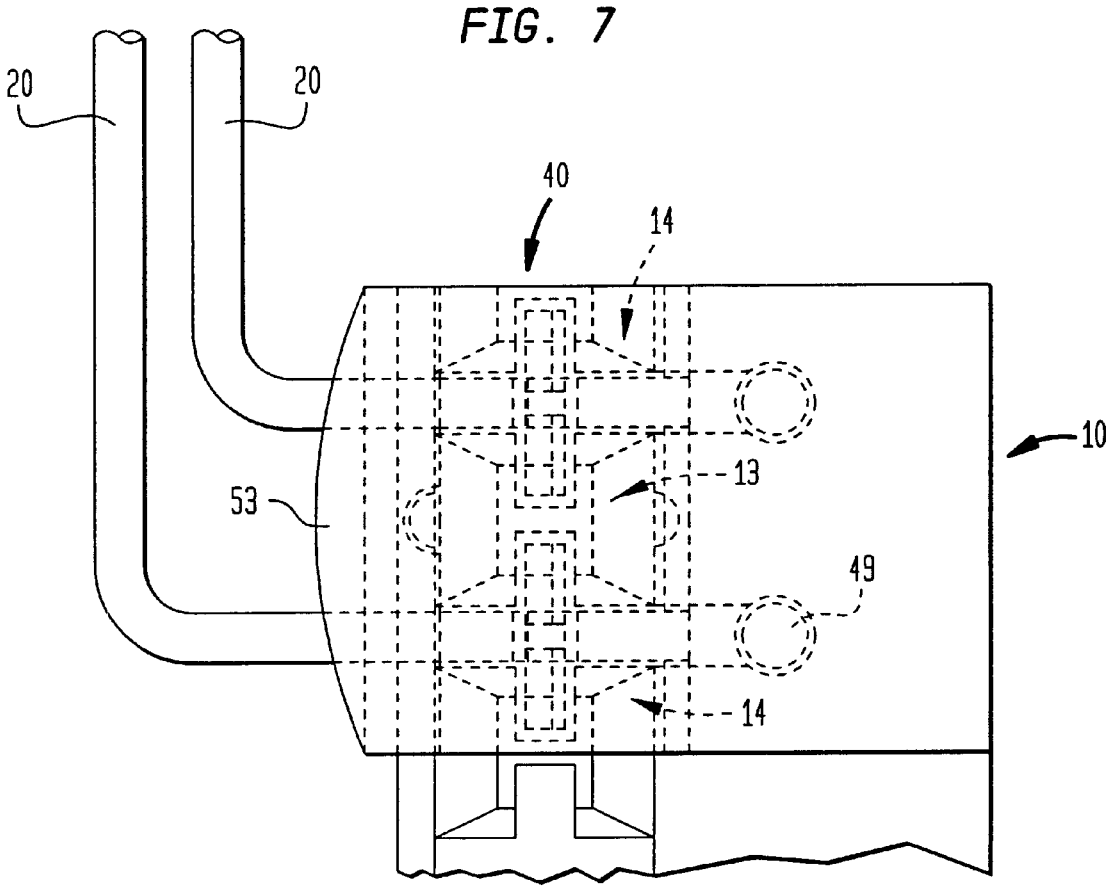
FIG. 7 is a top plan view of the modified connector module in a closed position, taken along line 7—7 in FIG. 1.

FIG. 7 illustrates the alignment of a pair of electrical conductors 20 with the ribs 42 and 43 and the funnel shaped entry slots 22 adjacent to alternating height teeth 13 when the push cap 40 is in the closed position.

Similarly, whether chambers 48 or 49 are used, the ends of the electrical conductors 20 are fully enclosed, isolated and restrained to provide strain relief and insulation in a simple positive manner.

Although certain features of the invention have been illustrated and described herein, better modifications and changes will occur to those skilled in the art. It is, therefore, to be understood that the appended claims are intended to cover all such modification and changes that fall within the spirit of the invention.

What we claim is:

1. A device for making electrical connections between at least one first conductor and at least one second conductor comprising:

(a) at least one insulation displacement connector for electrical engagement with said at least one first conductor and said at least one second conductor, said insulation displacement connector being electrically conducting;

(b) a body member having a plurality of spaced-apart teeth defining a plurality of entry slots therebetween for positioning said at least one first conductor for engagement with said insulation displacement connector; and (c) at least one push cap pivotably connected to said body member to closed and open positions, said push cap having a bottom surface for snubbing said at least one first conductor in response to said push cap being closed so as to electrically engage said at least one first conductor with said insulation displacement connector and one or more pair of cylindrical chambers in alignment with said entry slots for insertion of said at least one first conductor in position for engagement with said insulation displacement connectors.

2. The device according to claim 1 further including an index strip which engages said at least one second conductor, wherein said body member further comprises:

(a) a plurality of spaced-apart teeth defining a plurality of entry slots therebetween for positioning said at least one first conductor for engagement with said insulation displacement connector; and (b) a pair of spaced-part legs straddling said index strip when said body member overlies said index strip.

3. The device according to claim 2, wherein each of said teeth having a flat top surface and tapered sidewalls for mating with said push cap.

4. The device according to claim 3, wherein said plurality of spaced-apart teeth have alternating height.

5. The device according to claim 3, wherein two of said tooth sidewalls are perpendicular to said entry slots, each of said two sidewalls further having a protuberance for engaging said push cap.

6. The device according to claim 2, wherein each of said pair of legs further having a plurality of apertures for snap mounting said pair of legs on said index strip.

7. The devise according to claim 6, wherein each of said pair of legs further having a plurality of scallop edging along the base of each of said leg for engaging said at least one second conductor along said index strip.

8. The device according to claim 2 wherein said bottom surface of said push cap comprises:

(a) a hollow interior having a front and rear wall; and (b) first and second notched ribs dimensioned to fit between said entry slots for snubbing said at least one first conductor into engagement with said insulation displacement conductors into engagement with said insulation displacement connector, said first and second ribs in alignment with said entry slots and perpendicular to said front and rear walls, extending from said front wall to said rear wall.

9. The device according to claim 8, wherein each of said notched ribs having an inner and outer sidewall, a central cavity defined by said front and rear walls of said hollow interior and said inner facing walls of said first and second notched ribs and a pair of end sections defined by said front and rear sidewalls of said hollow interior and said outer facing walls of said first and second notched ribs, said central cavity and said pair of end sections mate with consecutive teeth of said body member.

10. The device according to claim 1, wherein said body member is made of a dielectric material.

11. The device according to claim 1 wherein said push cap further having a top surface and a ledge extending beyond said top surface.

12. The device according to claim 1, wherein said push cap is made of a dielectric material.

13. A device for making electrical connections between at least one first conductor and at least one second conductor comprising:

(a) at least one insulation displacement connector for electrical engagement with said at least one first conductor and said at least one second conductor, said insulation displacement connector being electrically conducting;

(b) a body member having a plurality of spaced-apart teeth defining a plurality of entry slots therebetween for positioning said at least one first conductor for engagement with said insulation displacement connector and a body extension having one or more pair of cylindrical chambers in alignment with said entry slots for insertion of said at least one first conductor in position for engagement with said insulation displacement connectors; and (c) at least one push cap pivotably connected to said body member to closed and open positions, said push cap having a bottom surface for snubbing said at least one first conductor in response to said push cap being closed so as to electrically engage said at least one first conductor with said insulation displacement connector.

14. The device according to claim 13 wherein said body member further comprises a pair of channels extending from said pair of cylindrical chambers of said body extension to said entry slots, said channels for resting said at least one first conductor upon engagement of said at least one first conductor with said insulation displacement connector.

15. The device according to claim 13 wherein said pair of cylindrical chambers of said body extension having a different diameter than said cylindrical chambers of said push cap for accommodating various sizes of said first set of conductors.

16. A device for making electrical connections between at least one first conductor and at least one second conductor along an index strip comprising:

(a) at least one insulation displacement connector;

(b) a body member having a plurality of spaced-apart teeth defining a plurality of entry slots therebetween, said body member having channels for mounting said insulation displacement connector in position for engagement with said at least one first conductor and said at least one second conductor, said entry slots for positioning said at least one first conductor for engagement with said insulation displacement connector, each of said teeth having a flat surface and tapered sidewalls;

(c) at least one push cap pivotably connected to said body member, said push cap comprising:

(i) a hollow interior having a front and rear wall;

(ii) a first and second notched ribs dimensioned to fit between said entry slots for snubbing said at least one first conductor into engagement with said insulation displacement connector, said first and second ribs in alignment with said entry slots and perpendicular to said front and rear walls, extending from said front wall to said rear wall, each of said notched ribs having an inner and outer facing wall;

(iii) a central cavity defined by said front and rear walls and said inner facing walls of said first and second ribs, said central cavity mates with one of said teeth of said body member in a closed position;

(iv) a pair of end sections defined by said front and rear walls and said outer sidewalls of said first and second ribs, each one of said pair of end sections mates with a corresponding tooth on opposite sides of said one tooth; and (v) one or more pair of cylindrical chambers in alignment with said entry slots for insertion of said at least one first conductor in position for engagement with said insulation displacement connectors by said first and second notched ribs.

17. The device according to claim 16, wherein said front wall of said hollow interior further having a recess, said rear wall of said hollow interior further having a recessed ledge, each of said two sidewalls perpendicular to said entry slots further having a protuberance, said recess and recessed ledge engage said protuberances to lock said push cap with said body member.

18. A device for making electrical connections between at least one first conductor and at least one second conductor comprising:

(a) at least one insulation displacement connector;

(b) an index strip which engages said at least one first conductor;

(c) a body member having a plurality of spaced-apart teeth defining a plurality of entry slots therebetween for positioning said at least one second conductor for engagement with said insulation displacement connector and a pair of spaced-apart legs adapted to straddle said index strip when said body member overlies said index strip;

(d) at least one push cap pivotably connected to said body member, said push cap comprising:

(i) a hollow interior having a front and rear wall;

(ii) first and second notched ribs dimensioned to fit between said entry slots for snubbing said at least one second conductor into engagement with said insulation displacement connector, said first and second ribs in alignment with said entry slots and perpendicular to said front and rear walls, extending from said front wall to said rear wall, each of said notched ribs having inner and outer facing walls;

(iii) a central cavity defined by said front and rear walls and said inner facing walls of said first and second ribs, said central cavity mates with one of said teeth of said body member in a closed position;

(iv) a pair of end sections defined by said front and rear walls and said outer facing walls of said first and second ribs, each one of said pair of end sections mates with a corresponding tooth on opposite sides of said one tooth; and (v) one or more pair of cylindrical chambers in alignment with said entry slots for insertion of said at least one second conductor in position for engagement with said insulation displacement connectors by said first and second notched ribs.

19. A device for making electrical connections between at least one first conductor and at least one second conductor comprising:

(a) at least one insulation displacement connector;

(b) an index strip which engages said at least one first conductor;

(c) a body member comprises:

(i) a plurality of spaced-apart teeth defining a plurality of entry slots therebetween for positioning said at least one second conductor for engagement with said insulation displacement connector;

(ii) a pair of spaced-apart legs straddling said index strip when said body member overlies said index strip; and (iii) a body extension having one or more pair of cylindrical chambers in alignment with said entry slots for insertion of said at least one second conductor in position for engagement with said insulation displacement connectors;

(d) at lease one push cap pivotably connected to said body member, said push cap comprising:

(i) a hollow interior having a front and rear wall;

(ii) first and second notched ribs dimensioned to fit between said entry slots for snubbing said at least one second conductor into engagement with said insulation displacement connector, said first and second ribs in alignment with said entry slots and perpendicular to said front and rear walls, extending from said front wall to said rear wall, each of said notched ribs having inner and outer facing walls;

(iii) a central cavity defined by said front and rear walls and said inner facing walls of said first and second ribs, said central cavity mates with one of said teeth of said body member in a closed position; and (iv) a pair of end sections defined by said front and rear walls and said outer facing walls of said first and second ribs, each one of said pair of end sections mates with a corresponding tooth on opposite sides of said one tooth.

20. A device for making electrical connections between at least one first conductor and at least one second conductor along an index strip comprising:

(a) at least one insulation displacement connector;

(b) a body member having a plurality of spaced-apart teeth defining a plurality of entry slots therebetween for positioning said at least one first conductor for engagement with said insulation displacement connector and a pair of spaced-apart legs adapted to straddle said index strip when said body member overlies said index strip, said body member having channels for mounting said insulation displacement connector in position for engagement with said at least one first conductor and said at least one second conductor, each of said teeth having a flat surface and tapered sidewalls;

(c) at least one push cap pivotably connected to said body member, said push cap comprising:

(i) a hollow interior having a front and rear wall;

(ii) first and second notched ribs dimensioned to fit between said entry slots for snubbing said at least one first conductor into engagement with said insulation displacement connector, said first and second ribs in alignment with said entry slots and perpendicular to said front and rear walls, extending from said front wall to said rear wall, each of said notched ribs having inner and outer facing walls;

(iii) a central cavity defined by said front and rear walls and said inner facing walls of said first and second ribs, said central cavity mates with one of said teeth of said body member in a closed position;

(iv) a pair of end sections defined by said front and rear walls and said outer facing walls of said first and second ribs, each one of said pair of end sections mates with a corresponding tooth on opposite sides of said one tooth; and (v) one or more pair of cylindrical chambers in alignment with said entry slots for insertion of said at least one first conductor in position for engagement with said insulation displacement connectors by said first and second notched ribs.

* * * * *